US005285213A

United States Patent [19]

Tusch

[11] Patent Number: 5,285,213

[45] Date of Patent: Feb. 8, 1994

[54] ELECTROMAGNETIC RADIATION REFLECTOR

[75] Inventor: Klaus N. Tusch, London, England

[73] Assignee: Colebrand Limited, London, England

[21] Appl. No.: 778,138

[22] PCT Filed: Apr. 12, 1991

[86] PCT No.: PCT/GB91/00581

§ 371 Date: Jan. 21, 1992

§ 102(e) Date: Jan. 21, 1992

[87] PCT Pub. No.: WO91/16735

PCT Pub. Date: Oct. 31, 1991

[30] Foreign Application Priority Data

| | | | |
|---|---|---|---|
| May 2, 1990 | [GB] | United Kingdom | 9009937 |
| May 11, 1990 | [GB] | United Kingdom | 9010604 |
| Aug. 21, 1990 | [GB] | United Kingdom | 9018306 |
| Apr. 12, 1991 | [GB] | United Kingdom | 9008401 |

[51] Int. Cl.[5] ..... H01Q 15/20; H01Q 15/18

[52] U.S. Cl. ..... 343/915; 343/916; 343/872; 342/8; 342/10

[58] Field of Search ..... 343/915, 872, 912, 914, 343/916; 342/5, 8, 10; H01Q 15/20, 15/18

[56] References Cited

U.S. PATENT DOCUMENTS

| | | | |
|---|---|---|---|
| 2,463,517 | 3/1949 | Chromak | 342/8 |
| 2,888,675 | 5/1959 | Pratt et al. | 343/915 |
| 3,010,104 | 11/1961 | Powell | 342/7 |
| 3,671,965 | 6/1972 | Rabenhorst et al. | 343/915 |
| 4,531,128 | 7/1985 | Mensa et al. | 342/7 |
| 4,673,934 | 6/1987 | Gentry et al. | 343/915 |
| 4,901,081 | 2/1990 | Bain, Jr. et al. | 342/8 |

FOREIGN PATENT DOCUMENTS

| | | |
|---|---|---|
| 0227950 | 7/1987 | European Pat. Off. . |

*Primary Examiner*—Donald Hajec
*Assistant Examiner*—Hoanganh Le
*Attorney, Agent, or Firm*—Fish & Richardson

[57] ABSTRACT

A reflector (3) may be mounted in a hollow housing (2) adapted to fly in ambient air. The reflector device (3) may be formed from a coating on the surfaces of blocks, the coating being metal or dielectric. Reflecting surfaces whether self supporting or not may be formed as intersecting circles or polygonal (more than four sides). They may be suspended in housing (2) adapted to fly either directly or indirectly by means of an intermediate body within the housing.

6 Claims, 1 Drawing Sheet

ELECTROMAGNETIC RADIATION REFLECTOR

BACKGROUND OF THE INVENTION

Reflectors providing a substantially uniform response in all directions have been made from three mutually orthogonal plates of metal. The plates may intersect along a centre line. In order to withstand exposure to weather, the metal has to be of substantial thickness and so the reflector is heavy which is inconvenient, particularly for example when the reflector is desired to be hoisted to the masthead of a sailing dinghy.

SUMMARY OF THE INVENTION

According to one aspect of the present invention there is provided a reflector comprising reflecting surfaces arranged in mutually inclined planes, the surfaces being formed on blocks of lightweight support material. The surfaces are preferably mutually orthogonal. The support material blocks are secured together with a metallic or dielectric coating on at least one of the facing surfaces, so that the reflecting coatings are not exposed to the weather. Complete protection can be achieved by encapsulating the block assembly and the capsule can provide means for suspending the reflector from a support. The thickness of the coating has only to be sufficient to act as a reflector and not to be self supporting.

In the prior art, reflectors where the metalized surfaces were self supporting and in the form of metal plates, the plates were diamond shaped. Whether the metalized surfaces are self supporting or not, we have discovered that by making the shape of individual metalized surfaces circular or at least closely approximating circular (e.g. polygonal with the number of sides exceeding 4) shape, an improved response is achieved.

According to another aspect of the invention there is provided a reflector comprising a plurality of mutually inclined surfaces, each of which extends on either side of lines in which it intersects another such surface, and has a circular or polygonal (with more than four sides) shape.

Although this reflector is light in weight, the blocks of support material are bulky. We have discovered that it is possible to support the metalized surfaces on elements within an inflatable envelope. The envelope is stored deflated and then expanded for use by air or another gas into a spherical shape then internal metalized elements within the envelope then provide the reflecting surfaces. Thus according to another aspect of the invention, there is provided a reflector comprising a plurality of mutually inclined surfaces, each of which extends on either side of lines in which it intersects another such surface, and the surfaces are elements mounted within an expandable envelope. The elements may be made of wire mesh or textiles and may include stretch fabrics in order to provide reduced resistance to the expansion of the envelope. In each case, the elements will be coated with metal, preferably silver.

The envelope can be inflated with air to a density of less than unity so it will float. Such reflectors can be thrown overboard from a vessel in order to provide a dummy reflector on the surface of the sea. Alternatively, a lighter gas can be used to inflate the envelope so that the reflectors will float in the air, either freely or tethered to a vessel to provide a desired pattern. The tethered reflectors can be return to the vessel when they have served their purpose. The envelopes can be deflated and stored flat for re-use.

Although the elements may be mounted directly to the envelope, it is preferable that they are secured indirectly to the envelope by being secured directly to an intermediate body which is mounted within the envelope.

In one example, the intermediate body is initially formed as a tube with open ends. This allows the elements to be inserted into the tube from one end and secured to its interior wall by any suitable means, such as clamping or stapling as well as by glueing. The ends of the tube are then closed and the tube is mounted within the main envelope. The tube and the envelope are inflated so that the tube changes from a sausage-shape (a cylinder with closed ends) to approximately a spherical shape as its central portion is expanded by inflation. The tube may be of slightly permeable material so that some of the inflating gas (such as helium) can escape through the walls of the tube to inflate the envelope or a separate port may be provided for inflation gas to enter the space between the tube and the envelope.

After inflation, the tube and the envelope approach each other in approximately spherical shape and the elements within the tube are drawn out to their intended final arrangement to provide a reflector of uniform all-around response. The inflated tube and envelope are then vulcanised so that they stick together. A suitable material for the envelope is a rubbery material. The tube should be of the same or at least a compatible material so that vulcanisation can take place.

The reflectors can be inflated so that they float in the air. The envelopes can be tethered so that the reflectors float at a predetermined height, thus providing a dummy target at that height, which is selected to be the height of the target the missile directing system is expecting. A dummy reflector left to float on the sea surface directly mounted to a floating raft might be rejected by the missile directing system, since the system may be programmed to only select targets which ressemble, for example, frigates whose vulnerable area (the engine room for example) target height will be many meters above the sea surface. A dummy reflector tethered at a height above a floating raft would not be rejected by such a missile system and so would be successful in causing the missile system to believe that it has found a genuine target.

According to another aspect of the present invention, there is provided a reflector for incident electromagnetic energy, comprising a hollow housing adapted to fly in ambient air and, interiorly thereof, a reflector device for reflecting incident electromagnetic radiation.

The housing may suitably comprise an envelope inflatable with a suitable gas.

The reflector device may comprise a substantially spherical device.

There may be a plurality of discrete spherical reflector devices housed in the housing, for example, three.

Each reflector device may comprise an aluminized cloth which is elastic and in the shape of a sphere.

There may be means to position each reflector device within of the housing.

The positioning means may comprise a plurality of separate connectors which extend substantially over the entire surface of a reflector device and are connected between the surface of the reflector device and the interior surface of the housing.

The connectors may comprise elasticized material strip connectors adapted to maintain the surface of the reflector device in tension and may preferably be in tension themselves.

The connectors may each be secured in position by engagement on one end with a tab at the interior surface of the housing and at the opposite end by a tab on the exterior surface of the reflector device.

A reflector embodying the invention is hereinafter described, by way of example, with reference to the accompanying drawing, which shows a schematic side elevational view, partly in phantom, of a reflector in the form of a kite balloon.

BRIEF DESCRIPTION OF THE DRAWINGS

Examples of the invention will now be described with reference to the accompanying drawings in which.

DESCRIPTION OF THE PREFERRED EMBODIMENTS

Figure 1:
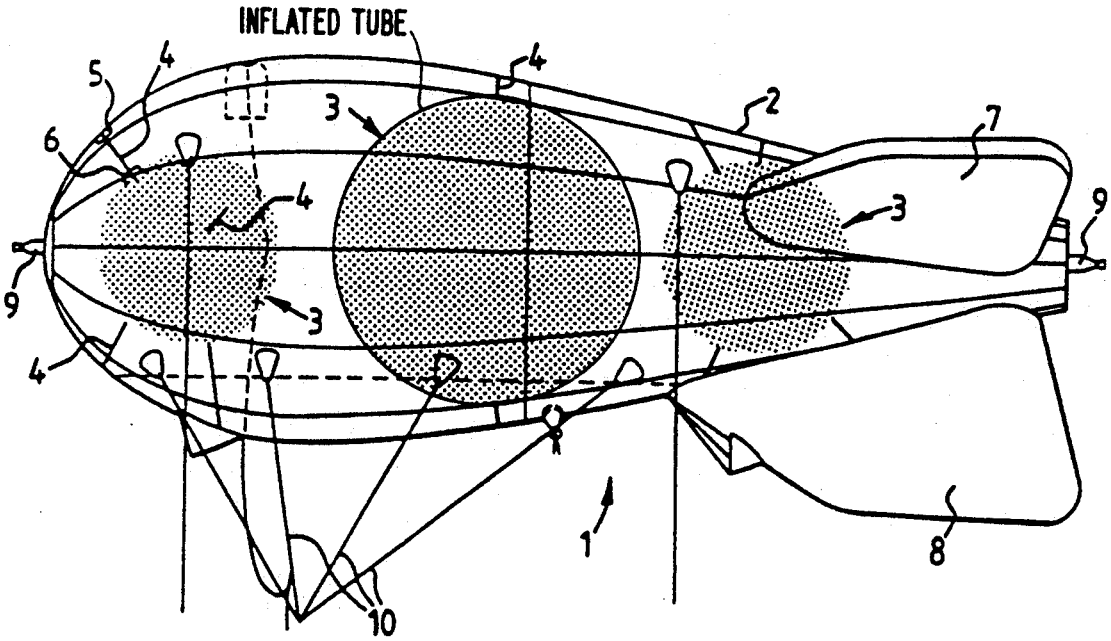
FIG. 1 shows a reflector comprising a reflector device within an inflatable housing.

FIG. 1 shows a reflector 1 for incident electromagnetic energy, in this case in the radar range, comprising a hollow housing 2 in the form of an inflatable balloon and, interiorly thereof, a reflector device 3 for reflecting incident radar beams.

There are three reflector devices 3 in the balloon 2 in the embodiment shown. Each is substantially spherical and is made from an aluminized cloth. The spheres 3 are maintained in tension, and thus spherical, by a positioning means comprised of elasticized strip material connectors 4 such as elasticized cloth (only some of which are shown). The connectors 4 extend over the whole surface area of the reflector device 3 and are connected between tabs 5 at one end on the interior surface of the housing 2 and at the opposite end by tabs 6 on the exterior surface of the spherical device 3. The tabs 5, 6 may comprise plastic or cloth flaps with holes through which a hook carried by the ends of the connectors 4 engage.

Only one set of tabs 5, 6 are shown for clarity. To manufacture the reflector 1 the material of the housing 2 is laid out as a sheet the tabs 5 are positioned as are the reflector devices 3 with the tabs 6 and the connectors 4 are connected up to maintain the reflector devices 3 in position. The material of the housing, suitably nylon coated polyurethane, is then folded so that opposite edges meet and these edges are then heat welded together, leaving fins 7 intact and an inflation nozzle(s) 9 in place.

When the housing is inflated with air or helium, the reflector 1 can be flown in the air from the mast-head of a yacht. The reflectors 3 inside reflect incident radar energy so that the position of the yacht can be identified. The configuration of the balloon 2 produces dynamic lift and the fins 7 and rudder 8 provide dynamic stability. The rudder 8 keeps the balloon heading into the wind and therefore provides a required "signature" whereby the identity of the yacht can be ascertained.

The reflector 1 may be tethered by suitable tethers 10.

Figure 2:
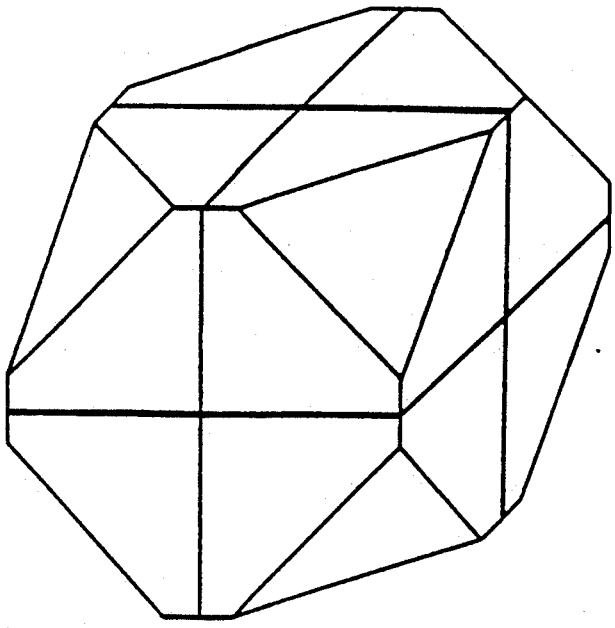
FIG. 2 is a perspective view of an exemplary reflector device.
Figure 3:
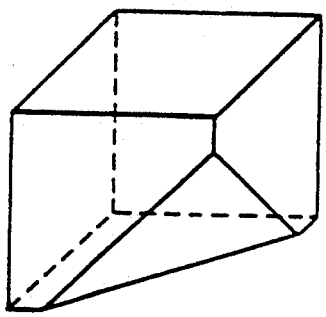
FIG. 3 is a perspective view of one block of FIG. 2.

The exemplary reflector device of FIG. 2 comprises eight identical blocks. One block is shown in FIG. 3. The block is a regular cube with one corner bevelled away with the edges leading so that the corner is about one fifth of the length of a full cube edge. The three remaining square sides of the cube are coated with aluminium, by any convenient method. The coating could alternatively be of a dielectric material since this also has reflecting properties for certain radiation. The eight blocks are secured together, square face-to-square face, to form a body substantially sphere-shaped, as shown in FIG. 2. The metal coatings are only exposed at their edges and this exposure can be protected by encapsulating the structure, for example in shrink wrap film or a more durable plastic coating. A supporting member (not shown) can be affixed to the envelope of the encapsulation or secured in between two blocks, so that the reflector can be secured to another structure or attached to a cable.

Figure 4:
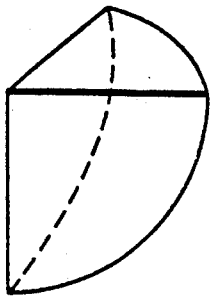
FIG. 4 is a detail corresponding to FIG. 3 of an alternative embodiment.

The alternate embodiment of FIG. 4 shows the individual block as an exact eighth of a sphere. The quarter circle surfaces are metal coated and secured together so that the full reflector is a sphere divided down three mutually orthogonal planes by the metallic coating.

The blocks are made of any suitable lightweight material which does not hinder the passage of radiation. Conveniently, they can be foamed plastics material. The blocks are conveniently secured together by glueing the metallic surfaces. The metallic coating can be applied to one or (preferably) both of the facing surfaces between adjacent blocks.

The various aspects of the invention can be used singly or in any combination.

I claim:

1. A reflector for reflecting incident electromagnetic energy, comprising a hollow housing adapted to fly in ambient air and, interiorly thereof, a reflector device for reflecting incident electromagnetic radiation, said reflector device comprising an inflatable envelope and reflecting means within said envelope, and wherein the housing is inflatable with a suitable gas.

2. A reflector as claimed in claim 1 wherein the reflector device comprises a substantially spherical device.

3. A reflector as claimed in claim 2 wherein the reflector device comprises an aluminized cloth which is elastic and formed into the shape of a sphere.

4. A reflector as claimed in any one of claims 1 to 3 comprising means to position the reflector device interiorly of the housing.

5. A reflector as claimed in claim 4 wherein the positioning means comprises a plurality of separate connectors which extend over substantially the whole surface of the reflector device and which are connected between that surface and the interior surface of the housing.

6. A reflector as claimed in claim 5 wherein the connectors comprise elasticated material strip connectors which are adapted to maintain the surface of the reflector device in tension.

* * * * *